United States Patent [19]

Taylor

[11] Patent Number: 4,962,934

[45] Date of Patent: Oct. 16, 1990

[54] GAME APPARATUS

[76] Inventor: John C. Taylor, 6650 E. Arizona, Denver, Colo. 80224

[21] Appl. No.: 361,228

[22] Filed: Jun. 5, 1989

Related U.S. Application Data

[63] Continuation-in-part of Ser. No. 96,162, Sep. 11, 1987, abandoned.

[51] Int. Cl.[5] ..... A63F 3/00

[52] U.S. Cl. ..... 273/249

[58] Field of Search ..... 273/242, 243, 248, 249, 273/275, 283

[56] References Cited

U.S. PATENT DOCUMENTS 1,224,173 5/1917 Kajiyama .
3,858,885 1/1975 Adcock .
4,065,131 12/1977 Martin, Jr. .
4,216,966 8/1980 MacRea .
4,279,422 7/1981 Shaw .
4,368,889 1/1983 Reker, Jr. .

*Primary Examiner*—Edward M. Coven
*Assistant Examiner*—William E. Stoll
*Attorney, Agent, or Firm*—Wm. Griffith Edwards

[57] ABSTRACT

An apparatus for a game simulating life experiences, comprising in combination, a game board having a main path of successive playing positions is provided with a short-cut path from one side of the main path to the other, and a return path from the short-cut to a position on the main path intermediate the entrance and exit of the short-cut. The disclosed game, by way of example, relates to college experiences and represents the effects which drinking may have on success in college life and graduation therefrom.

16 Claims, 6 Drawing Sheets

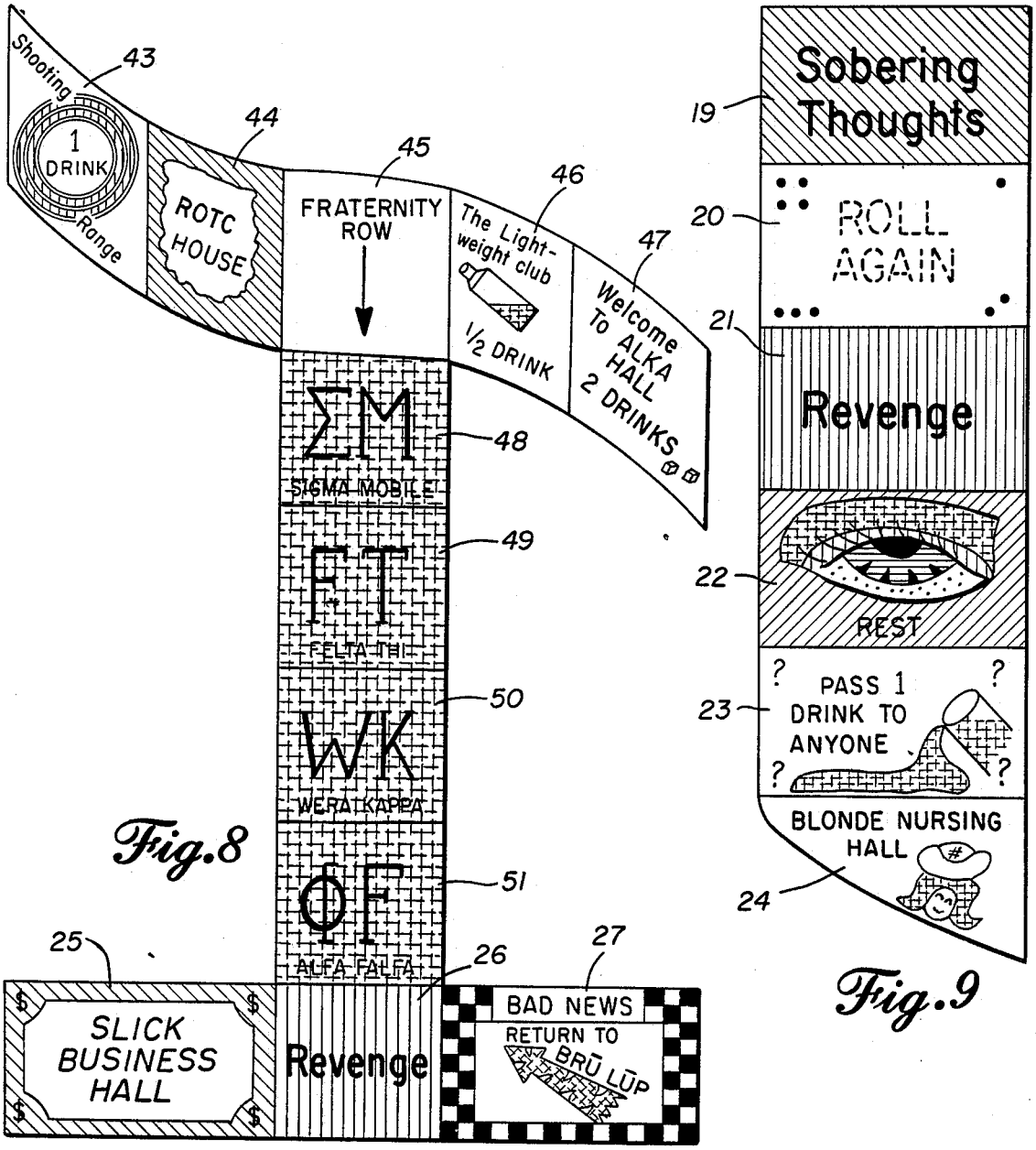
Fig.8
Fig.9
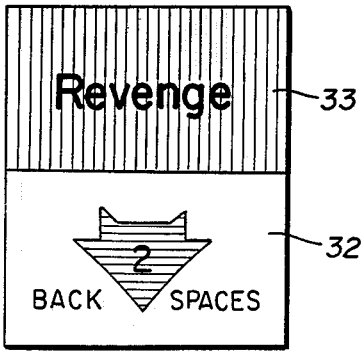
Fig.10
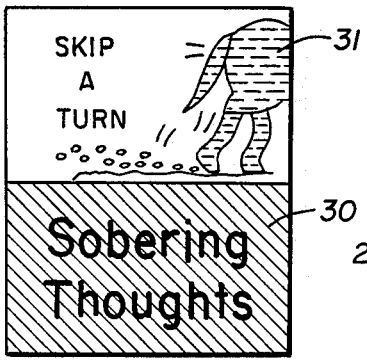
Fig.11
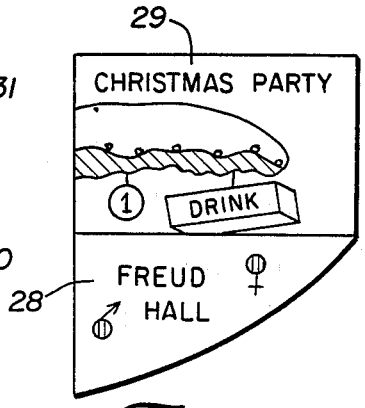
Fig.12

SOBERING THOUGHTS

At the block party, first day of school, you had to be a star so you drank and drank until you threw up on your secret admirer's car. Take 3 drinks.

You love the dorm food. You should should be sent to Freud Hall for close examination. Instead go to Blonde nursing hall so you don't die. Wash poison down with 1 drink.

While cramming for the Theology final, you took a few too many speeders. Your coma lasted thru finals week and summer break. sit out 2 turns.

Your room was gutted by fire. In it was your fake ID, a keg tap, and $2,500 student loan. You'll make a good pizza deliverer. Take 2 drinks.

Fig. 13

REVENGE

The $100 klunker you bought last summer was hit by the rich kid's Mercedes. Insurance paid you $600. Move ahead 5 spaces.

You and your friends were taken to jail on a drunk driving charge. Not only were you under 18, but you were sober. For being smart, Roll again.

For playing so honestly, use this card to go to the bathroom or sell it for 3 drinks. Hang onto this card for as long as you like.

You were found passed out under a broken, just pulled fire alarm. Fortunately, the finger prints did not belong to you. Resume play as normal.

Fig. 14

FRATERNITY ROW

On your scavenger hunt, the bra you returned with did not have the owner's signature on it as requested; take 4 drinks.

During hell week you failed to address one of the brothers as sir; take 3 drinks.

When asked the number of steps up to the front door of the fraternity national headquarters you answered incorrectly. Take 3 drinks.

During hell week you were seen on campus without the rock you're required to always carry. Now carry a rock 3 times as big and take 4 drinks.

Fig. 15

CONGRATULATIONS GRADUATE?

Your internship in psychology caused you to go crazy. Since beer is a good sedative, take 2 drinks and finish on the 5 year plan.

Congratulations! You have been drafted. Go back to the ROTC building, skip a turn, and hope you can finish on the 5yr. plan.

Senior - 2nd semester
P. E. - D
Bus 100 - F
Phil 420 - F
Sewing - D

Better go on the 5 year plan

Your business degree has placed you a Vice President of the nation's leading car manufacturer. Congratulations, you have successfully graduated. Yes, you won! Go throw up if you must.

Fig. 16

GAME APPARATUS

This application is a continuation-in-part of application Ser. No. 07/096,162 filed Sept. 11, 1987 now abandoned.

This invention relates to apparatus for a chance controlled game representing various phases and events of college life during the four year course. The game is of the type employing a board having a marked course of successive stations and which employs a plurality of stacks of cards to be drawn at designated stations to determine the advance of the players along the course.

SUMMARY OF THE DISCLOSURE

The board is marked with a course of successive stations extending from a first station about the course beginning at an entry station and ending at a terminal station adjacent the entry station. Each station requires some act to be performed by the player or a penalty is assessed and a number of stations are spaced at intervals each requiring the player to draw a card from a designated stack of cards. Each turn around the course represents a college year and a fifth year is provided to the unfortunate players who do not complete their course in four years. A shortcut path is provided across the board and a return penalty path is provided from the center of the shortcut path to a station on the main path intermediate the junctions with the shortcut. The stations and the cards correspond to or represent various points during the game. The return path is provided with a plurality of stations one or more of which is or are card drawing stations. For the purpose of delay, directions on the board may require the stations to be taken one by one instead of on a regular turn of the die or dice. A single die is preferred in order that the players may by chance be required to take a single step.

It is important to the game that all players remain actively playing each game until it is terminated. In view of this, any player who leaves the game is automatically out of the game. The only exceptions to this rule occur because a player has picked a permit card or has landed on a playing position granting permission to leave, in such case, the game will continue until that player's turn has come around again and then it will be suspended until the player's return. Either soft drinks or alcoholic beverages, no stronger than beer may be used.

BRIEF DESCRIPTION OF THE DRAWINGS

FIG. 8 is an enlarged view of the central cutoff and return path of the course and the central three stations at the bottom of the board;

FIG. 9 is an enlarged view of the lower six stations below the bottom of FIG. 6;

FIGS. 10, 11 and 12 are enlarged views of the six lower stations on the right hand column of FIG. 1 which are positioned in order respectively opposite the six left hand stations of FIG. 8;

FIG. 13 is a view of four of the cards for the "Sobering Thoughts" card stack;

FIG. 14 is a view of four of the cards for the "Revenge" card stack;

FIG. 15 is a view of four of the cards for the "Fraternity Row" card stack;

FIG. 16 is a view of four of the cards for the "Congratulations Graduate?" card stack;

DETAILED DESCRIPTION OF THE DRAWINGS

Figure 1:
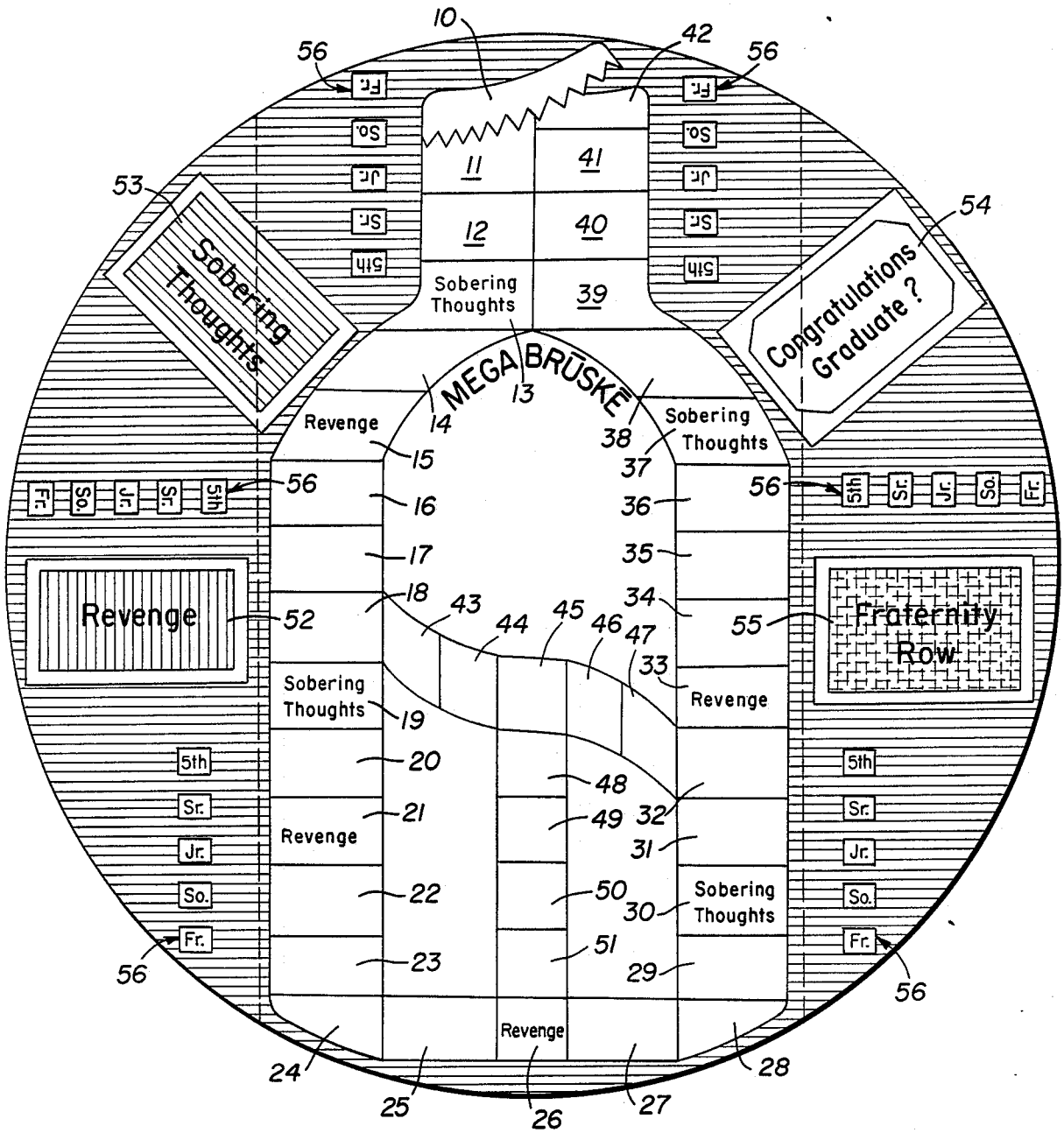
FIG. 1 is a plan view of a game board embodying the invention.
Figure 2:
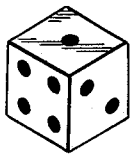
FIG. 2 is a perspective view of a die used with the game.

The game is played on a circular board as indicated in FIG. 1. The board is provided with a bottle shaped central field having 33 spaces numbered consecutively from 10 through 42 about the outer border of the bottle. The game has been called the "MEGABRUSKE GAME" and that name has been placed on the bottle area in the upper portion thereof below the neck. A shortcut or by-pass path of five spaces extends across the middle of the central portion of the bottle figure, the spaces being numbered from 43 through 47; a return path extends centrally from the shortcut to the bottom of the main path or course, the spaces of the return path being numbered 48, 49, 50 and 51. The positions for four stacks of cards include a Revenge position at 52, a Sobering Thoughts position at 53, a Congratulations Graduate? position at 54 and a Fraternity Row position at 55. Stacks of instruction cards are placed on each of the respective positions 52 through 55.

It will be seen that the playing paths of the game board comprise a main path having a series of game playing positions and extending about the board in the general shape of a bottle, and a centrally located shortcut path extending from one side of the bottle to the other and connecting the two sides of the main path to by-pass the lower or sub-portion of the main path. Further, a return is provided from the center of the by-pass path to a position directly below where it joins the main path. Thus the main path is divided into an upper portion and a lower portion which may be considered as a sub-series of playing positions, the ends of the by-pass being connected to the ends of the sub-series, and the return path being connected between the center position of the by-pass and that of the sub-series. These positions are not critical and the board may be provided with other positions of the junctions of the paths to provide variations of the game.

Figure 3:
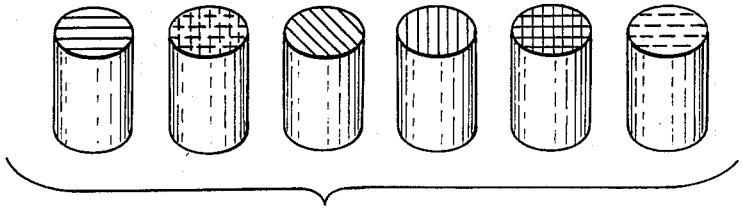
FIG. 3 is an isometric view of six game pieces marking the players positions on the board each piece being of a different color.
Figure 5:
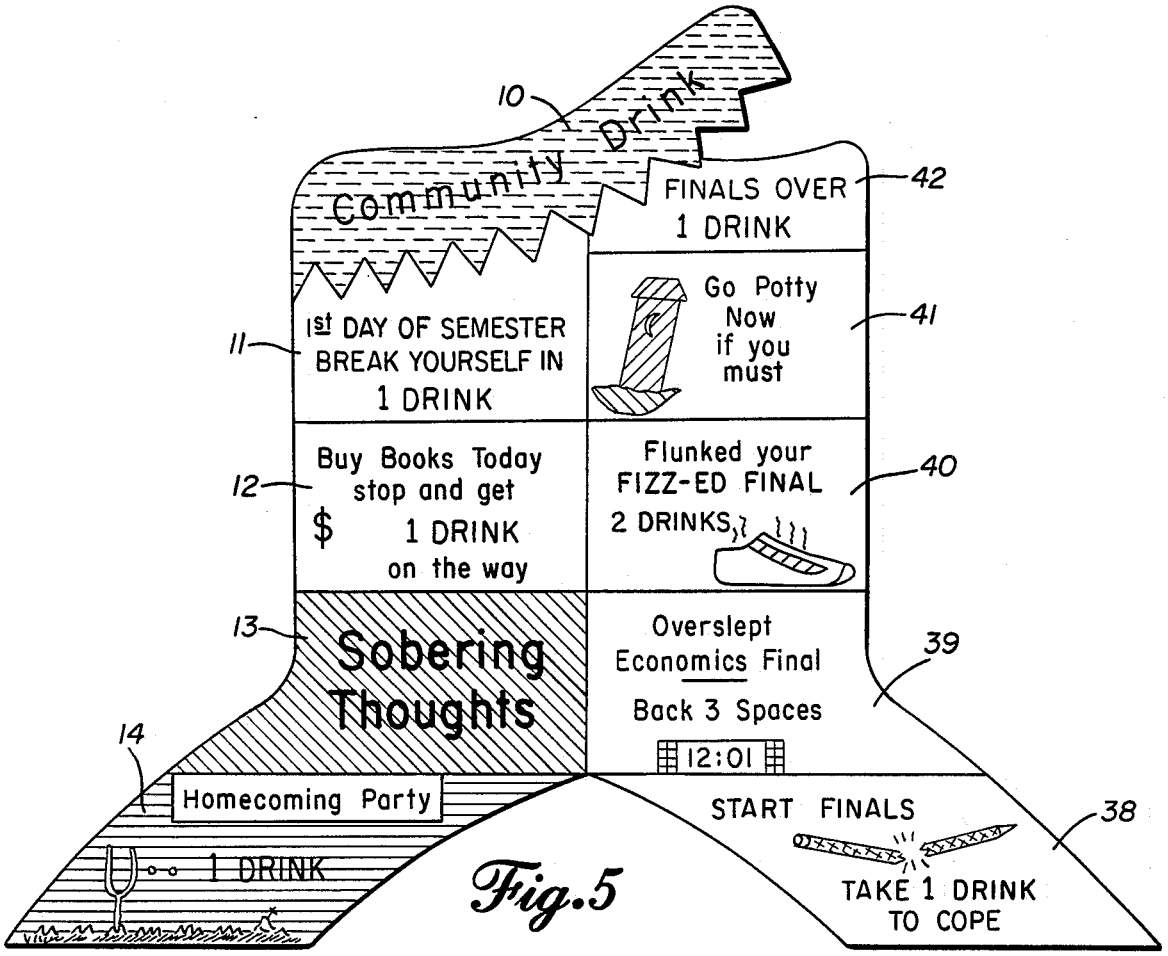
FIG. 5 is an enlarged view of the top ten stations on the bottle—shaped course.
Figure 6:
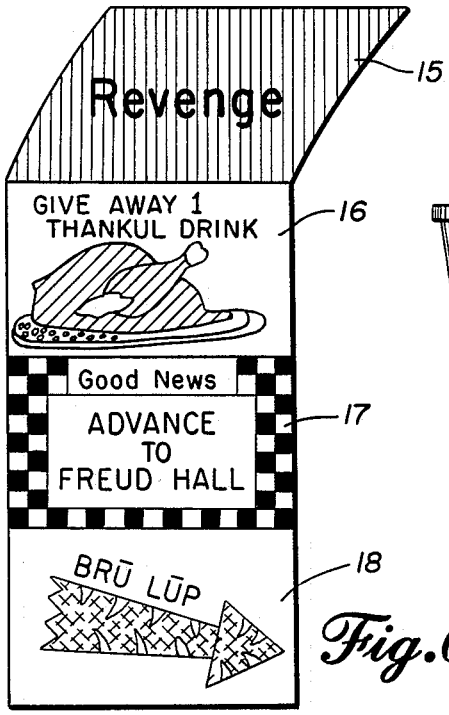
FIG. 6 is an enlarged view of the next four stations below the left hand side of FIG. 5.

Six playing pieces are provided for the players as indicated in FIG. 3, each piece being marked distinctively, for example, being of a different color, as illustrated by the example of the different colors indicated on the tops of the game pieces in FIG. 3. Movement of a playing piece from the bottle cap 10 down the left hand side of the bottle across the bottom and back on the right hand side to the top space 42 represents a college year. Rows 56 of five small rectangles each representing one of the freshmen, sophomore, junior, senior and fifth year of college are provided to designate the status of each player according to the number of times the piece has moved around the course. The stacks of cards 52 and 53 entitled REVENGE and SOBERING THOUGHTS are used by the players when they land on the corresponding positions bearing these names and the stack 55 entitled FRATERNITY ROW is used when the player is moving over the four positions 48 through 51 in the vertical return path. The fourth stack 54 entitled CONGRATULATIONS GRADUATE? is used by each player on completion of four trips around the course.

Figure 4:
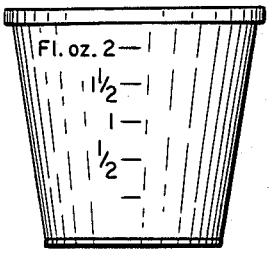
FIG. 4 is a side elevation view of a measuring cup which may be used in playing the game.
Figure 7:
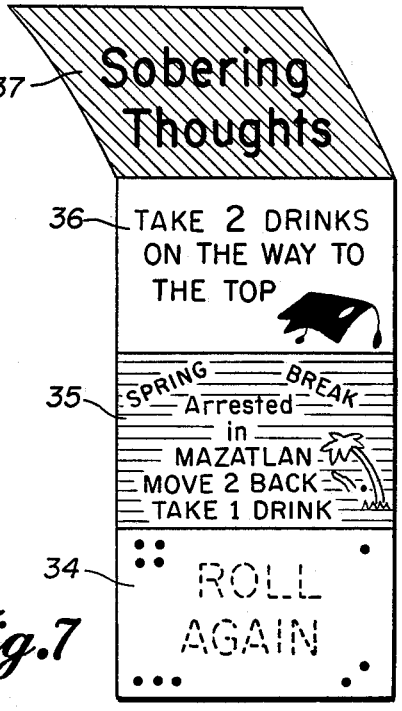
FIG. 7 is an enlarged view of the next four stations below the right hand side of FIG. 5.

At the beginning of a game each player is given one of the game pieces which is used throughout the game. Players also decide on the size of the drinks to be taken and each is given a measuring cup for use during the game. The cup as shown in FIG. 4 is a two ounce cup marked in ½ ounce, 1 ounce, 1½ ounce and 2 ounce measures. The players decide on the size of drink to be taken under the drink instructions of the game and the players then roll the die or dice as the case may be, the player with the highest number or total is then first to play, the other taking their turns in the order in which they are seated about the board. A single die is preferred since it is desirable that a player can move a single space as the shortest move.

The first player then rolls the die and moves the number of spaces indicated starting with the "Community Drink" space at the top of the course. Each player takes a drink on entering or passing the "Community Drink" space. The first player then counts the number of spaces indicated by the die which has been rolled and moves to the designated space. The player then follows the instructions on the space or having landed on the "Sobering Thoughts" space or the "Revenge" space, picks a card from the corresponding stack and follows the instructions on that card. However, on the first round all the players are designated freshmen and each player marks the freshman position on his row of status indicators. When a player has completed a turn the next player on the left then throws the die and follows the instructions in the same manner. Each player moves about the course from position 10 around to position 42 and back to position 10 for each college year. Examples of instructions on the cards are shown in FIGS. 5 through 12; if a player lands on the space 18 marked BRULUP, he or she must on his or her next turn enter the shortcut path shown in FIG. 8 which includes the spaces 43, 44, 45, 46 and 47. If the player then lands on the "Fraternity Row" space 45, he or she must, on his or her next throw of the die, follow the arrow and move onto the "Fraternity Row" spaces.

The arrangement of the "Fraternity Row" path provides four card pick up positions ending at the "Revenge" position 26 on the main path which is followed by the "Bad News" position 27. When the player is using a single die, any number rolled will require a card to be picked up or the return of the player's game piece to the entrance of the by-pass path. Any number rolled will result in some delay of the player. However, by chance, the player may have to make only one stop after his first move from the entrance to "Fraternity Row". The amount of delay caused by the "Fraternity Row" path may vary widely. Furthermore, when using two dice, the degree of delay along "Fraternity Row" may be considerably less and may be negligible.

The possibility remains that the player again will have to start on the shortcut path and may be returned to "Fraternity Row". The shortcut path and "Fraternity Row" thus provide a hazard in the course which may result in a substantial delay of a player in finishing the course, or, if the player does not land on the "Fraternity Row" position then the course is shortened by the shortcut. However, if the player lands on the "back 2 spaces" position then a "Sobering Thoughts" card must be drawn.

When a player has finished the fourth round of the course he or she draws a card from the "Congratulations Graduate?" stack 54. Instructions in this card stack include those represented by the four cards shown in FIG. 16 three of which require a return to the course and completion of a fifth round. Should another player complete the four rounds and graduate before the player in the fifth round completes his or her round then the other player wins otherwise the player completing the fifth round will win.

The cards shown in FIGS. 13, 14, 15 and 16 are representative of the cards in each respective stack. All stacks may have the same number of cards or different numbers as determined before the game. The following tables indicate, by way of example, different cards which may be selected for use with those in the respective stacks shown in the drawings.

SOBERING THOUGHTS

You flunked your mid-term in Algebra. Drown your sorrows with 2 drinks.

During the first warm week of spring, you tried on your last year's designer swimsuit. You couldn't pull it past your knees. Dorm food perhaps? Go to "Fraternity Row" you MOO-Hepher.

You forgot to check the top of the salt shaker. Your last dollar hamburger is ruined. Clean up the mess with 2 drinks.

You put regular fuel in your dad's Ferarri. Everyone saw you pushing it to the mechanic. $500.00 will pay for the new engine; or 3 drinks. Since you're pushing uphill move back 2 spaces.

Instead of getting measured for your cap and gown, you spent your Friday afternoon playing MegaBruSke. Explain to your parents why you are the only one among thousands in street clothes. Take 2 drinks, No. 3.

You lost the key to your dorm room. Instead of a $40.00 charge, take 1 drink.

You accidentally registered for Statistics 411 instead of 140. Skip your next turn.

Your school football team won the homecoming game! Raw! You lost a bet. For having no faith in school spirit, take 3 drinks.

REVENGE

They pressured you to join Greek life for your whole college career. You may send someone now to "Fraternity Row".

You went to the cosmetology school for an inexpensive haircut. Now your head looks like an old war injury. Person playing now, besides you, with the shortest hair may take 1 drink.

You have been elected as President of Student Council. Move ahead 3 spaces.

As a computer whiz, you tapped into the school computer that retains your grades. Take an "A" and move ahead 3 spaces.

While experimenting in Bio 101, you accidentally discovered a cure for the common cold. You are now a millionaire. Advance your class status 1 year and roll again.

You were picked to be on the school calendar. You have no problems getting a date for the rest of the year. Give away 2 drinks to anyone.

Short for money, you volunteered as a test rat for a psychology experiment using electric shock as negative reinforcement for aversive behavior. You didn't averse enough. Now your hair is burned off permanently. You won your $25,000.00 lawsuit. Trade places with the most advanced person playing now.

The pizza dude dropped your pizza on your doorstep, put it back in the box and delivered it to you. The manager at the Pizza place didn't do anything. The District Mgr. found out and awarded you free pizza all year. Everyone can take 2 drinks, except you.

FRATERNITY ROW

Last week you and your pledge brothers kidnapped 3 actives, drove them 200 miles away to drop them off in the middle of nowhere. When you goons stopped for gas you left the keys in the ignition, hope you had a good walk back to campus, drown thirst with 4 drinks.

Releasing pigs in a sorority house was funny. Too bad the house mother recognized you, now clean up the mess and move back 1 space, and skip next turn.

Not wearing your pledge pin in public is the most serious crime possible, you don't deserve to be in a fraternity. Move back to Shooting Range—I think you get the hint.

While on phone duty at the house you failed to answer the phone in 2 rings or less; take 3 drinks and go by the name—, until next turn.

When the whistle blew you failed to line up with the other pledges in less than 10 seconds. It took you 14, therefore take 4 drinks.

When asked the number of steps up to the front door of the fraternity national headquarters, you answered incorrectly. Take 3 drinks.

As President of your pledge class you managed to sneak the key into the football stadium, but when the brothers got there at game time, the beer was not cold enough; take 4 drinks.

CONGRATULATIONS GRADUATE?

There are no jobs for comedians. Your Political Science degree has led you down a path of unemploymentism. Go back to Brulup and finish on the five year plan.

Your parents flew 1500 miles to see you graduate. At the ceremony your name was never called. Surprise! One more year should give your parents enough time to save money to come out again next year. Finish on the 5 year plan.

There was an error made on your Grad-Check a year ago. They mistook Bio 467 for 3 P.E. classes. Better see if one more year will do it.

You cheated on your English Competency exam. Go to Homecoming Game and finish on the 5 year plan.

Since you never went to a fraternity party, you missed out on a lot. Try the 5 year plan by going to "Fraternity Row".

Congratulations—you have graduated.

The game proceeds from beginning to end with each player subject to plays which depend upon the roll of the die or dice and upon the chances on the drawing of cards. An increase or decrease in the individuals playing time is caused by landing or not landing on the "BRULUP" and "Fraternity Row" spaces. The short-cut starting at the "BRULUP" space and the delay in passing through "Fraternity Row" are significant in determining the fortunes of the players.

Figure 17:
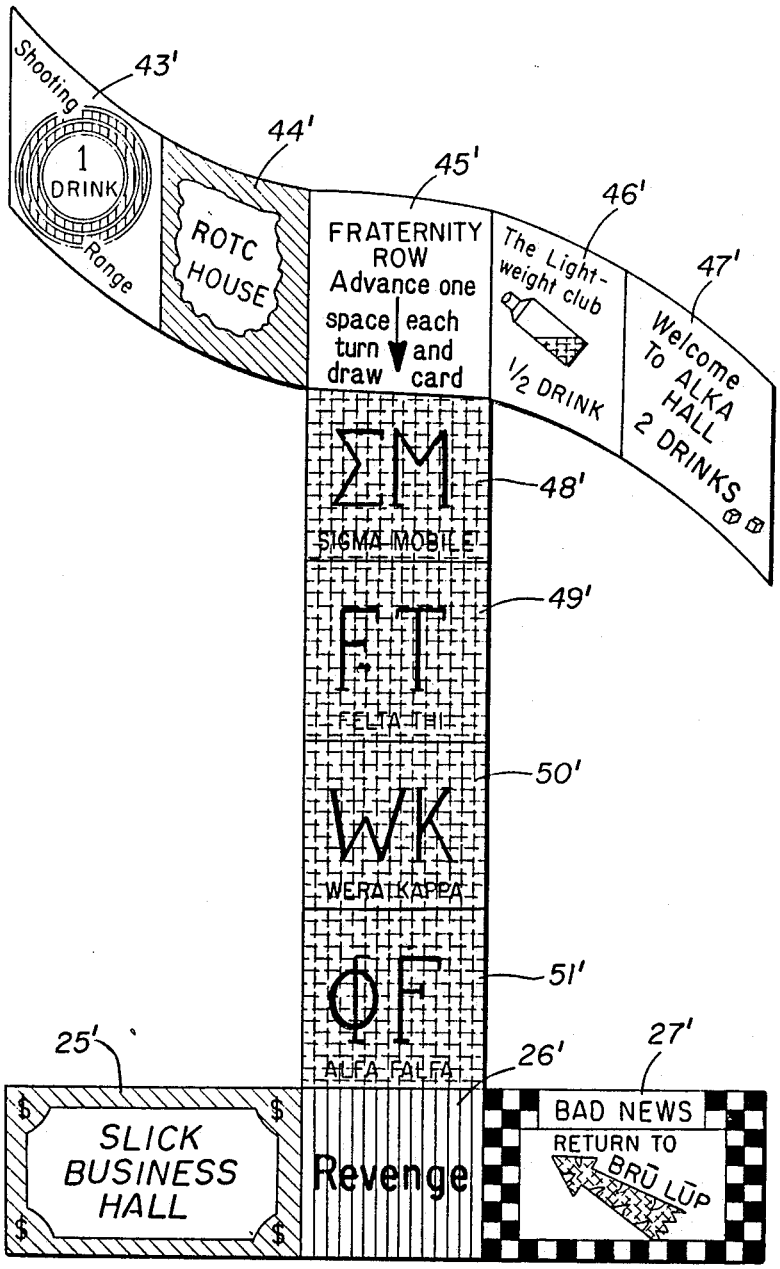
FIG. 17 is a view, the same as that of FIG. 8 and containing instructions for players reaching the junction of the central cutoff path and the vertical return path.

Passage through "Fraternity Row" may be governed by providing a rule of the game requiring the player landing on "Fraternity Row" not to roll the dice but to advance only one space on each turn. However, when a higher risk game is desired, the board may be modified to include a direction on the "Fraternity Row" position 45', as shown in FIG. 17 which includes the same numerals as in FIG. 8 each with a prime. The instruction on the board requires the player whose playing piece has landed on the position 45' to advance along "Fraternity Row" one space for each turn and draw a card. With this instruction on the board the player does not roll the die or dice, but advances one space on each turn until he has reached the last space in the "Fraternity Row" group. Considerable delay may be encountered by the player in the passage through "Fraternity Row" while moving one space for each turn. After the player has taken the four turns along "Fraternity Row" he continues to advance by rolling the die on each turn in the normal procedure.

While specific embodiments of the invention have been illustrated and described various modifications and changes will occur to those skilled in the art and it is intended, by the accompanying claims, to cover all modifications and arrangements which fall within the true spirit and scope of the invention.

I claim:

1. Game apparatus comprising in combination a plurality of game playing pieces to be moved by players corresponding thereto in playing a game, a game board with a plurality of game path means defined thereon to be followed by any one of said game playing pieces, said plurality of game path means comprising main path means including a main path series of game playing positions to be followed by any one of said game playing pieces, and said plurality of game playing path means further including by-pass path means, and return path means, said main path series of game playing positions terminating at path starting and ending means for said main path means, said by-pass path means having a game piece entrance end at a first junction in common with an entrance end of a sub-series of game playing positions included intermediately in said main path series of game playing positions and said by-pass path means further having a game playing piece exit end in a second junction in common with a game playing piece exit end of said sub-series of game playing positions, whereby said by-pass path means fully by-passes said sub-series of game playing positions, and said return path means has a playing piece entrance third junction with said full by-pass path means at a location between said first and second junctions and a playing piece exit fourth junction with said sub-series of game playing positions at a location between said first and second junctions, whereby said return path means partially by-passes both said by-pass path means and said sub-series of game playing positions.

2. Game apparatus as set forth in claim 1, wherein said apparatus includes chance means for a player of said game to select according to chance whether said game piece corresponding to said player should be moved to travel from said first junction along said by-pass path means or along said sub-series of playing positions in said main path means, and for said player to select whether said game piece when along said by-pass path means should be moved to travel along said return path means from said third junction to said fourth junction or past said third junction directly to said second junction.

3. Game apparatus as set forth in claim 2, wherein said return path means comprises game piece travel delay means including a series of game playing positions predetermined as to number in said series for any one of said game playing pieces reaching a predetermined game playing position in advance of said return path series thereafter to be step-advanced at least one of said game playing positions along said return path series, in turn of play, accordingly delaying travel of said game piece along said return path series to be during several turns of play.

4. Game apparatus as set forth in claim 3, wherein said apparatus comprises chance means for any one of said players of said game to select instructions according to chance from a variety of instructions applicable to when having said game playing piece situated along said return path series of playing positions.

5. Game apparatus as set forth in claim 2, wherein said chance means for a player of said game to select route of a game piece according to chance includes, at least one die to be thrown to ascertain by chance the number of game playing positions on said board any one of said game playing pieces should be advanced, and select by chance a change of route for said game piece by having any one of said game playing pieces coincide by chance with a predetermined one of said game playing positions on said board.

6. Game apparatus as set forth in claim 4, wherein said apparatus includes, said draw chance means including at least one stack with said cards in said stack having a variety of instructions thereon to be selected by chance according to card draw.

7. Game apparatus as set forth in claim 1, wherein said main path series of game playing positions has a configuration suggestive of that of a bottle profile.

8. Game apparatus as set forth in claim 7, wherein said main path series of game playing positions has a configuration suggestive of that of a bottle profile with said path starting and ending means of said main path series of game playing positions being suggestive of a neck of said bottle profile.

9. Game apparatus as set forth in claim 8, wherein said bottle profile suggested by said main path series of game playing positions includes having said by-pass series of game playing positions inside said bottle profile and interconnecting said sides of said bottle profile across said first and second junctions made by said by-pass series of game playing positions with said main path series of game playing positions.

10. Game apparatus as set forth in claim 4, wherein said main path series of game playing positions has a configuration suggestive of that of a bottle profile, and said variety of instructions including those being applicable to quantity of liquid to be consumed consistent with when said game piece for a given one of said players occupies one of said return series of game playing positions.

11. Game apparatus as set forth in claim 2, wherein said apparatus includes game piece travel delay means for travel of a game piece along said return path means to be delayed, the latter said means having a series of game playing positions along said return path means be of a predetermined number for any said game playing piece selected by chance along said by-pass path of game playing positions in advance of said return path series thereafter to be manually step-advanced a predetermined plurality of times (independently of chance) along said return path series before reaching said main path sub-series of game playing positions, thereby increasing travel time of said game piece along said return path means.

12. Game apparatus as set forth in claim 11, wherein said game piece travel delay means is characterized by said predetermined number of game playing positions in said return path series exceeding that needed for said game playing piece to be step-advanced (independently of chance) from said by-pass path series of game playing positions to said sub-series of game playing positions in a single turn of play of said game.

13. An apparatus for a game simulating life happenings and experiences, comprising in combination a game board having a main path comprising a series of successive playing positions extending around the board from a starting position to a finishing position each playing position representing a happening or experience or giving instructions or requiring the taking of a card, a shortcut path extending from a position on one side of said series of playing positions to a position on the other side of said series, a return path between a position on said shortcut path and a position on said main path intermediate the ends of said shortcut path and having at least one card stack designating position, a plurality of stacks of instruction cards, a plurality of positions at intervals along said main path each designating a stack from which a card is to be drawn, the positions on said main path intermediate said card stack positions having thereon instructions for the player, a player who lands on the entrance to said shortcut path being required to take said shortcut path on his or her next turn and on landing on the entrance to said return path one position for each turn to play until he or she again reaches the main path, said at least one return path card stack designating position requiring the player to draw a card from the return path stack.

14. An apparatus for a game simulating college experiences and the effects that alcoholic beverages may have on a students success in completing the college course, comprising in combination a game board having a main path comprising a series of successive playing positions extending around the board from a starting position to a finishing position each playing position representing a happening in a college career, or giving instructions or requiring the taking of a card, a shortcut path extending from a position on one side of said series of playing positions to a position on the other side of said series, a return path between a position on said short-cut path and a position on said main path intermediate the ends of said shortcut path, playing pieces movable into said playing positions for indicating the respective positions of the players, a chance means for determining the movements of the playing pieces, a plurality of stacks of instructions cards, a plurality of positions at intervals along said main path each designating a stack from which a card is to be drawn, the positions on said main path intermediate said card stack positions having thereon instructions for the player, a player who lands on the entrance to said shortcut path being required to take the shortcut on his or her next turn and on landing on the entrance to said return path being required to follow said return path one position at a time on each of the next turns of play until he or she again reaches the main path, a plurality of said positions requiring the player to draw a card from the return path stack, the instructions on said cards and on said intermediate positions including directions for the taking or giving of drinks by the player.

15. A game apparatus as set forth in claim 1 wherein all of the positions on said return path are card stack designating positions.

16. A game apparatus as set forth in claim 2 including a plurality of small measuring cups for the players.

* * * * *